US010354508B2

(12) United States Patent
Chang et al.

(10) Patent No.: US 10,354,508 B2
(45) Date of Patent: Jul. 16, 2019

(54) INK-STAINING ANTI-THEFT CASH BOX

(71) Applicant: INTERNATIONAL CURRENCY TECHNOLOGIES CORPORATION, Taipei (TW)

(72) Inventors: Chia-Min Chang, Taipei (TW); Hung-Yi Chang, Taipei (TW); Chia-Hung Hu, Taipei (TW); Yi-Hsin Chen, Taipei (TW)

(73) Assignee: INTERNATIONAL CURRENCY TECHNOLOGIES CORPORATION, Taipei (TW)

( * ) Notice: Subject to any disclaimer, the term of this patent is extended or adjusted under 35 U.S.C. 154(b) by 0 days.

(21) Appl. No.: 15/891,725

(22) Filed: Feb. 8, 2018

(65) Prior Publication Data

US 2019/0130715 A1 May 2, 2019

(30) Foreign Application Priority Data

Oct. 26, 2017 (TW) ..... 106215835 U

(51) Int. Cl.

| | |
|---|---|
| ***G08B 15/02*** | (2006.01) |
| ***G07D 11/225*** | (2019.01) |
| ***G07F 19/00*** | (2006.01) |
| ***G07G 3/00*** | (2006.01) |

(52) U.S. Cl.

CPC ..... *G08B 15/02* (2013.01); *G07D 11/225* (2019.01); *G07F 19/205* (2013.01); *G07G 3/003* (2013.01)

(58) Field of Classification Search

CPC ..... G08B 15/02; G07D 11/225; G07G 3/003; G07F 19/205; E05G 1/12; E05G 1/14

USPC ..... 109/20, 25, 29–34; 194/350

See application file for complete search history.

(56) References Cited

U.S. PATENT DOCUMENTS

| | | | | |
|---|---|---|---|---|
| 3,676,945 A * | 7/1972 | Neanhouse | G08B 15/02 | 109/33 |
| 4,799,435 A * | 1/1989 | Boutroy | G07D 11/12 | 109/25 |
| 5,156,272 A * | 10/1992 | Bouchard | E05G 1/14 | 109/25 |
| 5,732,638 A * | 3/1998 | Van Lint | E05G 1/005 | 109/29 |
| 6,178,897 B1 * | 1/2001 | Appeltans | E05G 1/14 | 109/33 |
| 6,712,011 B2 * | 3/2004 | Fumanelli | E05G 1/005 | 109/20 |

(Continued)

*Primary Examiner* — Lloyd A Gall

(74) *Attorney, Agent, or Firm* — Muncy, Geissler, Olds & Lowe, P.C.

(57) ABSTRACT

An ink-staining anti-theft cash box includes a cash box mounted in a host machine for receiving and storing bills, an ink-jet module and an anti-theft security device consisting of a gas cylinder, a needle valve unit, a drive unit and a trigger unit. When the trigger unit detects abnormal separation of the cash box from the host machine, the trigger unit is triggered, and the drive unit is activated to move the gas cylinder toward the needle valve unit from a first position to a second position where an air seal diaphragm of the gas cylinder is pierced by the needle valve unit, and the compressed gas of the gas cylinder is released through an ink tub into an ink cartridge to force an ink out of a nozzle assembly of the ink-jet module for staining storage bills in the box body, enhancing the security level of the cash box.

15 Claims, 13 Drawing Sheets

(56) References Cited

U.S. PATENT DOCUMENTS

| | | | | |
|---|---|---|---|---|
| 8,464,648 | B2 * | 6/2013 | Villiger | E05G 1/14 109/25 |
| 8,783,194 | B2 * | 7/2014 | Sleat | D21H 21/46 109/20 |
| 8,899,399 | B2 * | 12/2014 | Nomura | G07F 7/04 194/206 |
| 2002/0029728 | A1 * | 3/2002 | Walker | E05G 1/14 109/25 |
| 2004/0154500 | A1 * | 8/2004 | Richard | E05G 1/005 109/25 |
| 2016/0376828 | A1 * | 12/2016 | Grant | G07D 11/12 109/29 |
| 2018/0313135 | A1 * | 11/2018 | Westington | G07F 19/209 |

* cited by examiner

INK-STAINING ANTI-THEFT CASH BOX

BACKGROUND OF THE INVENTION

This application claims the priority benefit of Taiwan patent application number 106215835, filed on Oct. 26, 2017.

1. Field of the Invention

The present invention relates to bill acceptor technology and more particularly, to an ink-staining anti-theft cash box, which utilizes an anti-theft security device to detect the connection relationship between the cash box and the host machine, and an ink-jet module is triggered to ink-stain bills in the cash box if the cash box is separated from the host machine without the normal disarming procedure, deterring criminals to limit their criminal acts and enhancing the security level of the cash box.

2. Description of the Related Art

Following fast development of modern technology, convenience and rapidness have become important factors in our modern daily life. Nowadays, various automated trading machines are used everywhere in cities to receive and recycle money and exchange it for the purpose of buying, selling or trading legal things. Typical automated trading machines include, but are not limited to, automatic vending machines, ATMs, game machines. These automated trading machines use a receiving unit for receiving bills, notes, securities, electronic money, electronic financial cards or other valuable documents by clients, a recognition device for detecting the authenticity and value of inserted items so that transaction of bill exchange bills or purchasing of goods or services can be performed to achieve unmanned operations and self-service purposes. In addition to significant savings in labor costs, the convenience of this transaction mode is more readily accepted by the modern world. With the increasing demand for the types and services of goods sold, more functions are required.

However, these automated trading machines normally run with no staff present (unattended) except the very short time period in which staffs fill up the machines with new supplies. An evil person may take bills, coins, stored value cards, tickets and other selling items from these unattended machines illegally. For example, an evil person may insert a cord attached bill into the bill slot of a vending machine to buy one selling item and then take up the cord to pull back the bill after getting the commodity. In order to prohibit an evil person from pulling back an inserted bill after trading, a vending machine may provide an anti-theft hook at the back side of the identify recognition device. Thus, a transaction can be executed only after the inserted bill has been verified and moved over the anti-theft hook. Further, a backstop device can be used in an automatic vending machine for lacerating a Mylar strip or plastic strip that is attached to an inserted bill, separating the inserted bill from the attached cord and preventing the cord from pulling back the bill.

Further, a criminal may use a tool, utensil or cutting device to destroy an automatic vending machine. The bill acceptors of conventional automatic vending machines are normally not equipped with a lock. Even a bill acceptor of an automatic vending machine is equipped with a lock, it can easily be destroyed, allowing the cash box to be removed from the bill acceptor without a normal unlocking procedure. The bills stolen from the cash box of an automatic vending machine can still be effectively circulated in the market, causing the automatic vending machine owner to suffer a great loss. Further, the police are a lot harder to find and trace the stolen bills and to quickly crack the criminal case.

Therefore, it is desirable to provide an anti-theft cash box for automated trading machine, which can effectively deter criminals to limit their criminal acts and significantly enhance the security level of the cash box.

SUMMARY OF THE INVENTION

The present invention has been accomplished under the circumstances in view. It is therefore one object of the present invention to provide an ink-staining anti-theft cash box, which comprises a cash box mounted in a host machine for receiving and storing bills, an ink-jet module and an anti-theft security device mounted in the cash box. The anti-theft security device consists of a gas cylinder, a needle valve unit, a drive unit and a trigger unit. When the trigger unit detects abnormal separation of the cash box from the host machine, the trigger unit is triggered, and the drive unit is activated to move the gas cylinder toward the needle valve unit from a first position to a second position where an air seal diaphragm of the gas cylinder is pierced by the needle valve unit, and the compressed gas of the gas cylinder is released through an ink tub into an ink cartridge to force an ink out of a nozzle assembly of the ink-jet module for staining storage bills in the box body, enhancing the security level of the cash box.

Preferably, the trigger unit of the anti-theft security device comprises a pressure bar stoppable by a mounting wall of the housing of the host machine, a sliding block, and a compression spring stopped between the pressure bar and the sliding block. The anti-theft security device further comprises a control module. The control module comprises a circuit board carrying a control circuit, a micro switch installed in an inner surface of the circuit board and triggerable by the sliding block, and a processing unit installed in the circuit board and electrically coupled with the micro switch for controlling the operation of the motor of the drive unit. When the trigger unit detects separation of the cash box from the host machine, the pressure bar is released from the constraint of the mounting wall to release the compression spring. At this time, the sliding block is forced by the compression spring to trigger the micro switch of the control module, causing the drive unit to move the needle valve unit in piercing the gas cylinder for allowing compressed gas to go into the ink tube so that the ink in the ink cartridge can be ejected out of the nozzle assembly to stain the bills in the cash box Preferably, the control module further comprises a Bluetooth module electrically coupled to the processing unit. When the site manager wants to unlock cash box or to remove it from host machine, the site manager can operate a built-in program of a mobile electronic device to transmit an unlock (disarm) instruction through a Bluetooth module wirelessly to the Bluetooth module of the control module, enabling the processing unit to disable the motor of the drive unit according to the received unlock (disarm) instruction, and thus, the anti-theft security device is disarmed. Thus, the site manager can remove the cash box from the host machine without triggering the anti-theft security device, preventing the ink-jet module from ejecting the ink to stain the storage bills in the cash box. After the site manager disengages the retaining rods of the box body from the respective retaining portions of the housing, the site manager can remove the cash box from the host machine and open the hollow frame type door panel of the box body to take storage bills out of the box body, and then to install the empty cash box in the host machine again.

Preferably, the control module further comprises a power supply device electrically coupled to the processing unit. The power supply device comprises a storage battery and a gold capacitor. The storage battery is electrically connected to the circuit board by a power line. The gold capacitor is directly installed in the circuit board. If the battery cannot normally provide power supply due to lack of activity or reduced endurance at low temperature, the gold capacitor can be triggered to release its storage energy to the control circuit of the circuit board, ensuring normal operation of the anti-theft security device. If the power line of the power supply device is cut off by a thief with a cutting tool, the gold capacitor can be triggered to provide storage energy, enabling the control module to activate the anti-theft function of the anti-theft security device.

Further, the motor of the drive unit drives the transmission mechanism to move the linkage lever for lever ratio torque conversion, forcing the slider to move the gas cylinder toward the needle valve unit so that the needle can accurately pierce the air seal diaphragm of the gas cylinder and the gas cylinder can release internal compressed gas through the ink tube of the ink-jet module into the ink cartridge. The design of the single-trip continuously curved runner in the ink cartridge ensures smooth flowing of the ink, so that the amount of residual ink is minimized.

DETAILED DESCRIPTION OF THE PREFERRED EMBODIMENT

Figure 1:
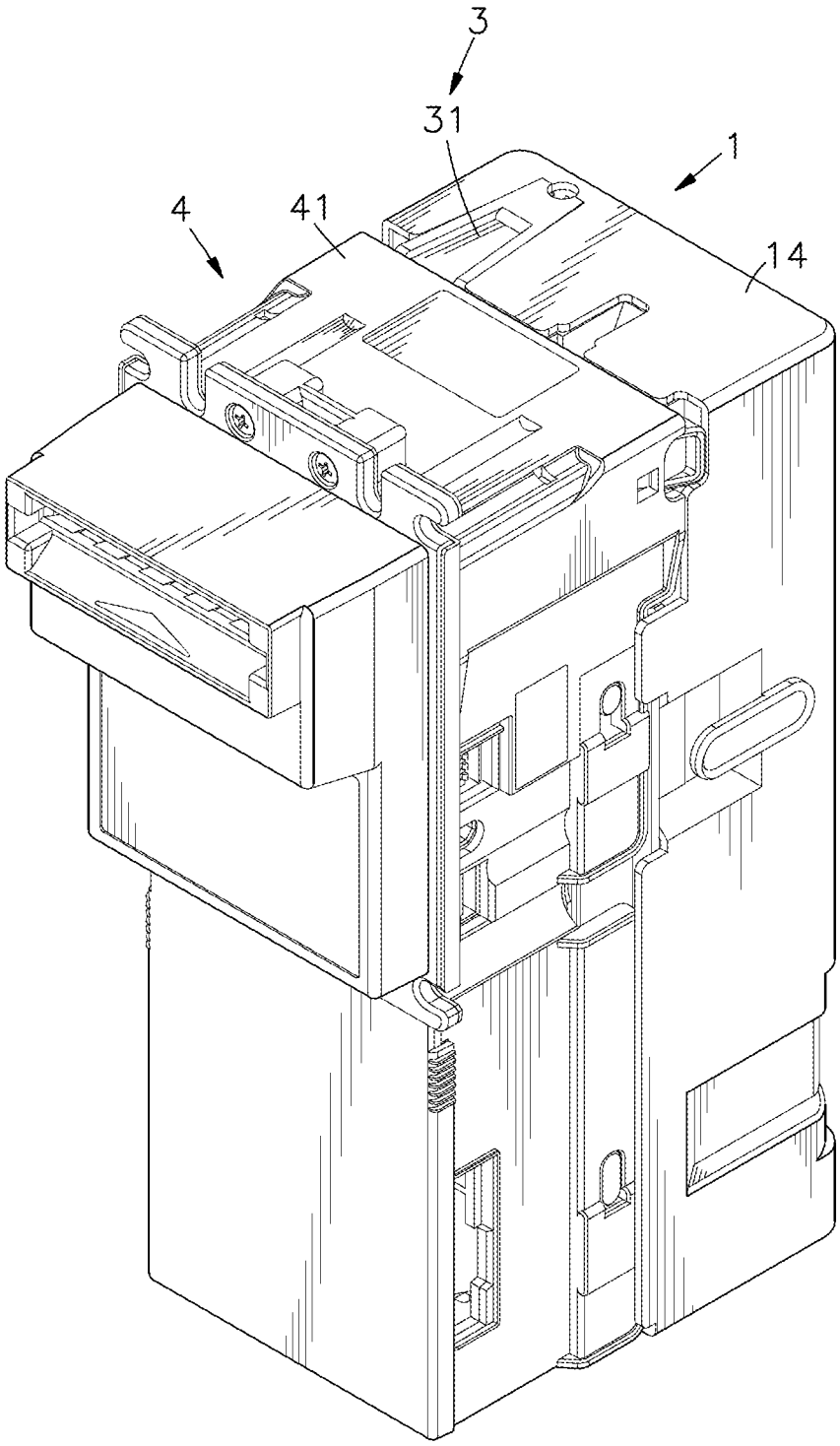
FIG. 1 is an oblique top elevational view of the combination of an ink-staining anti-theft cash box and a host machine in accordance with the present invention.
Figure 2:
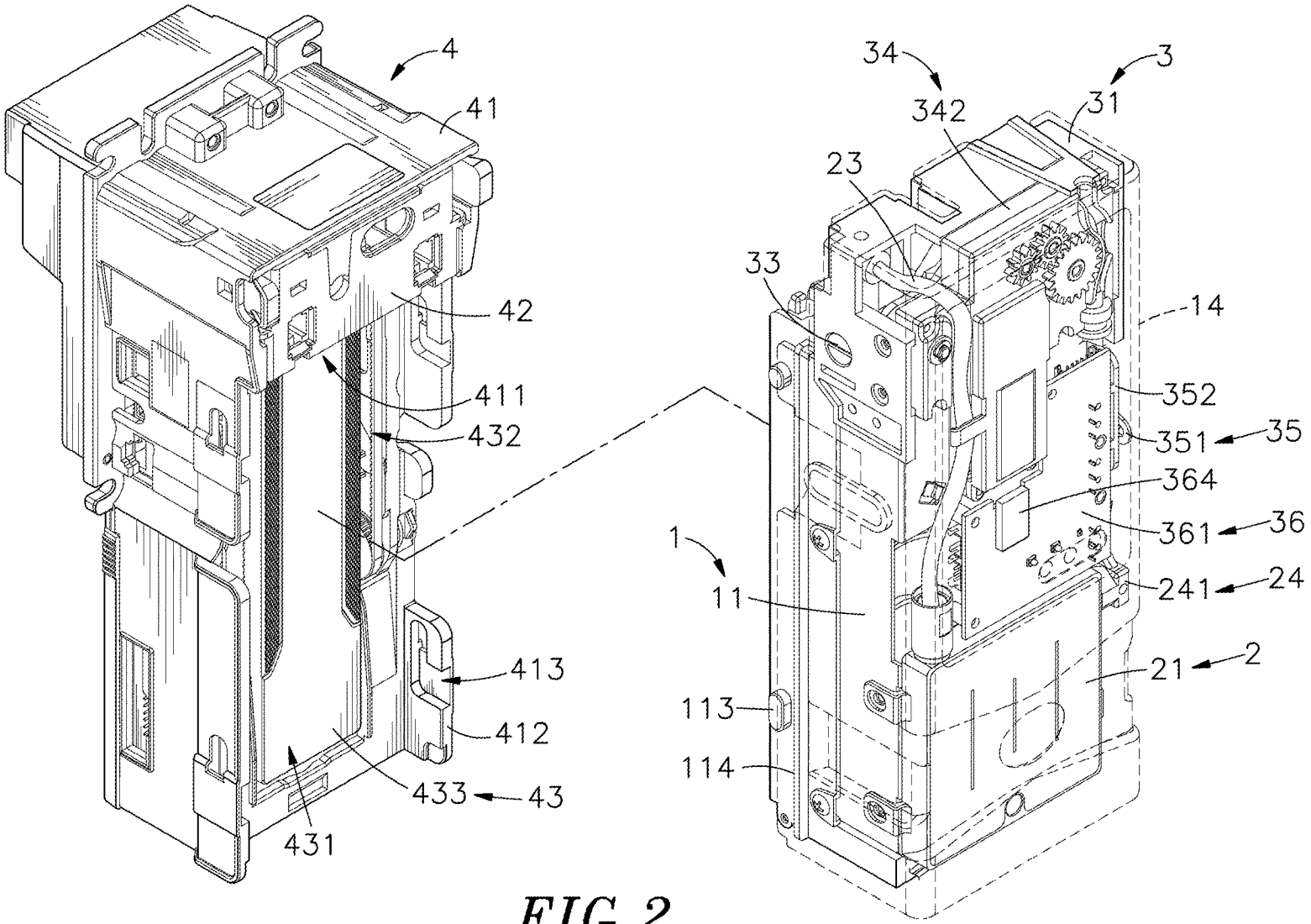
FIG. 2 is an exploded view of the combination of ink-staining anti-theft cash box and host machine shown in FIG. 1.
Figure 3:
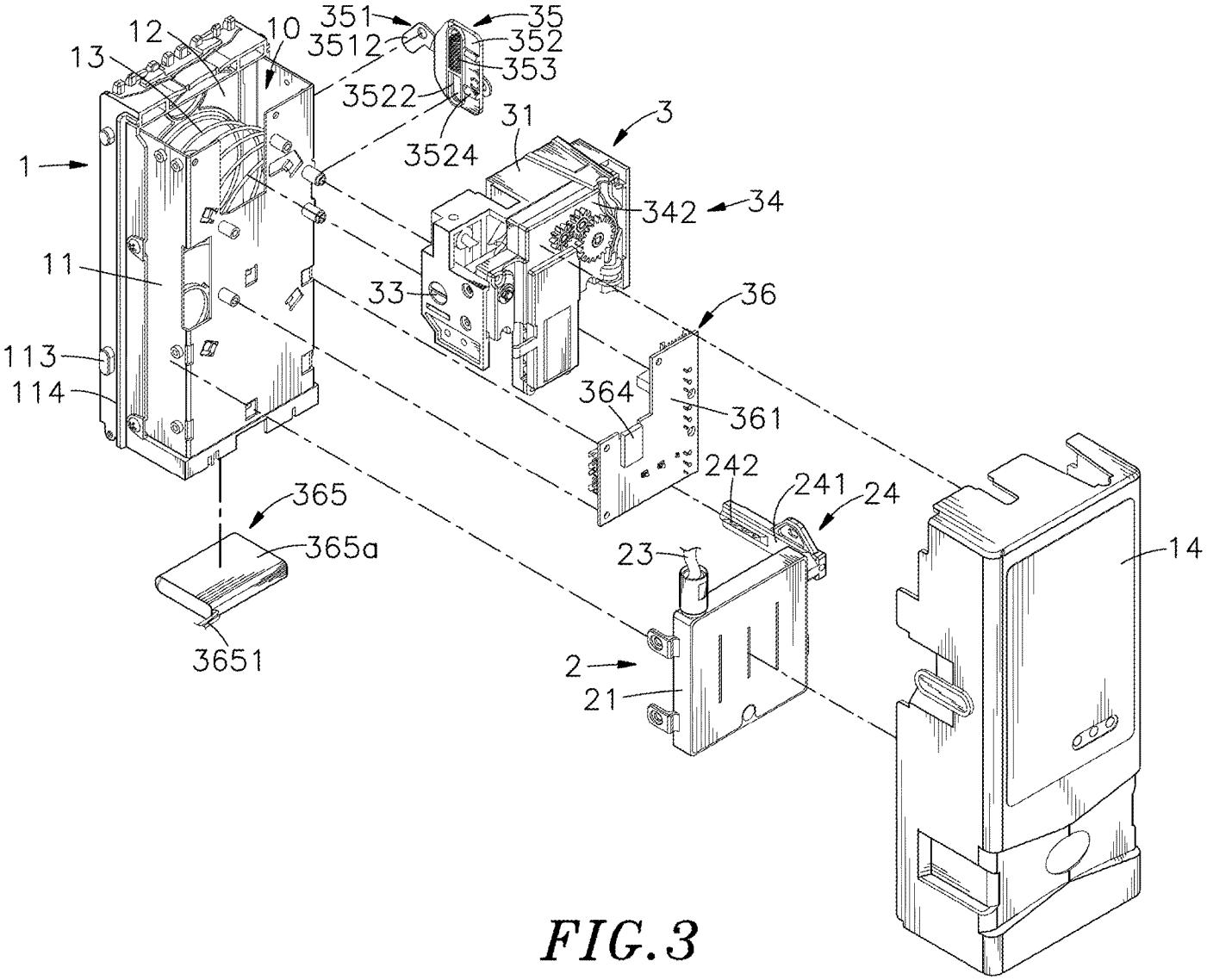
FIG. 3 is an exploded view of the ink-staining anti-theft cash box shown in FIG. 1.
Figure 4:
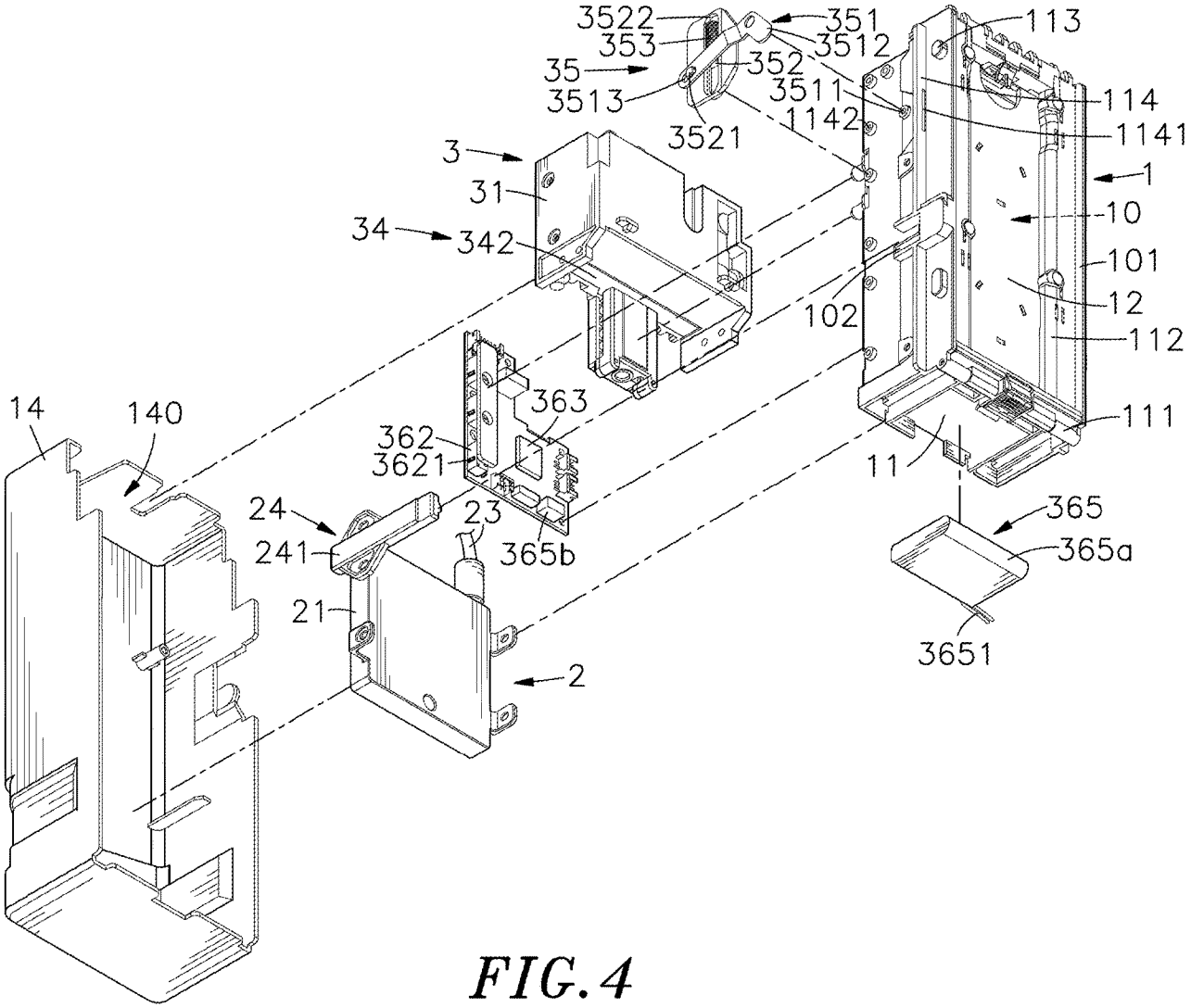
FIG. 4 corresponds to FIG. 3 when viewed from another angle.
Figure 5:
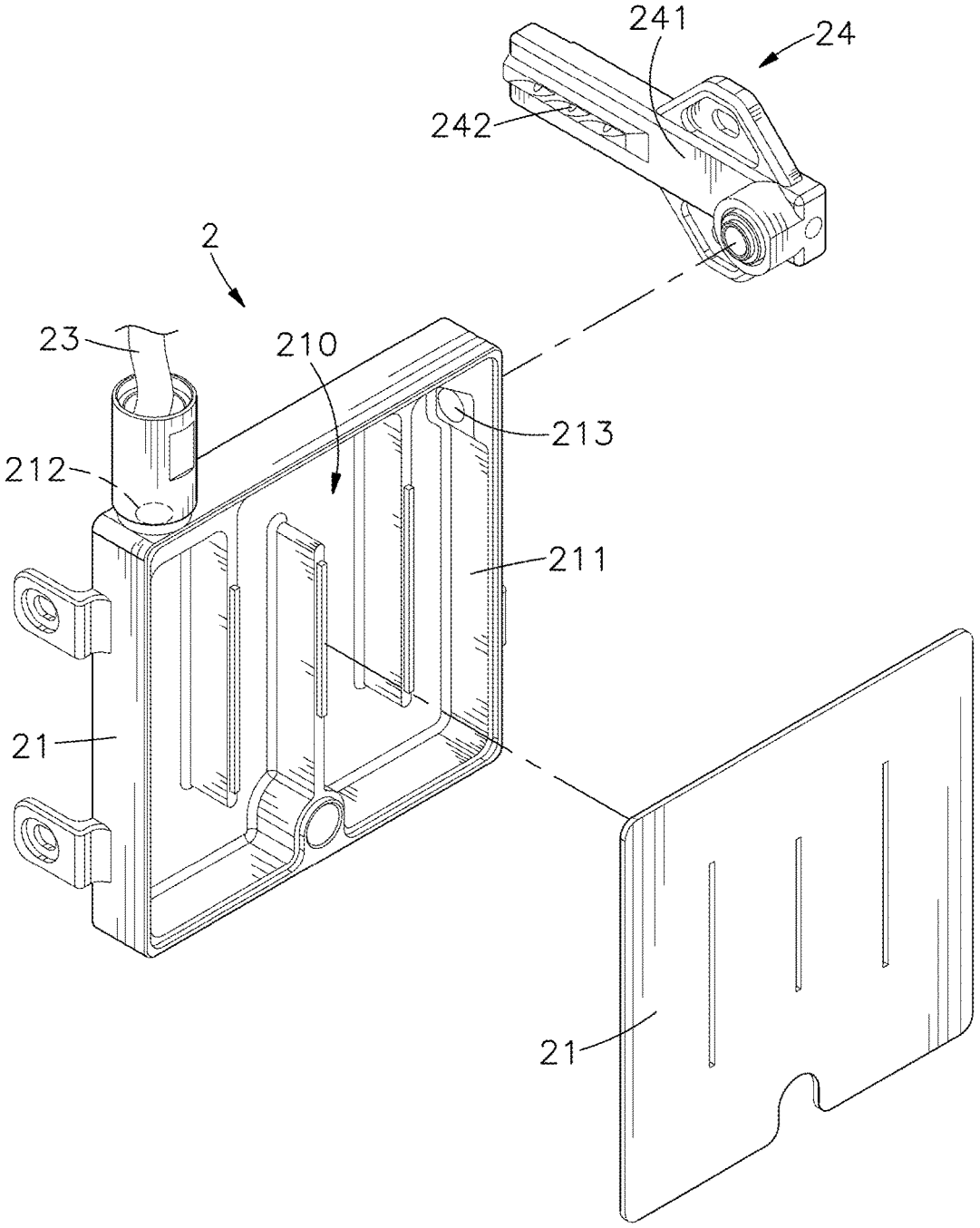
FIG. 5 is an exploded view of the ink-jet module.
Figure 6:
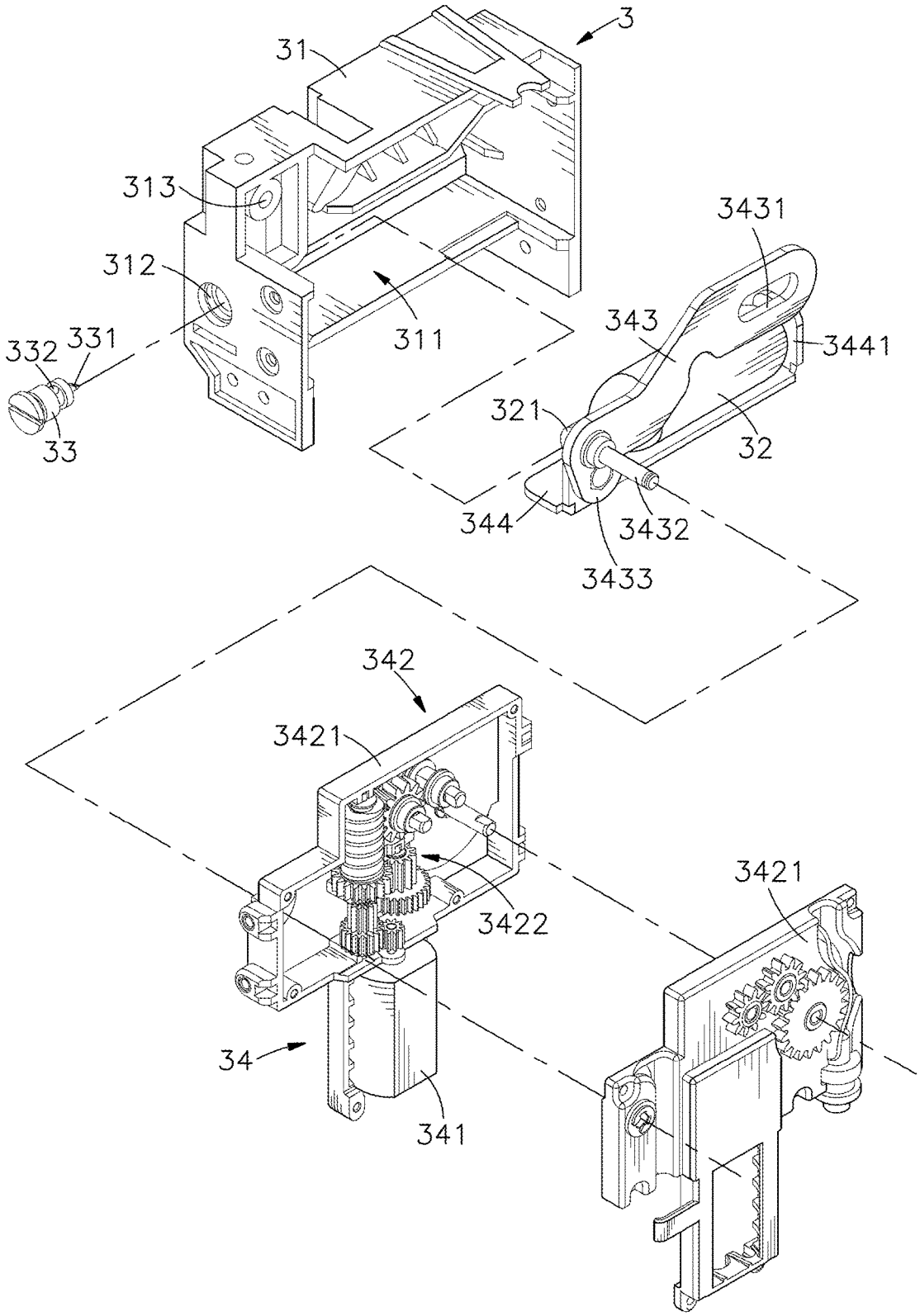
FIG. 6 is an exploded view of the anti-theft security device.
Figure 7:
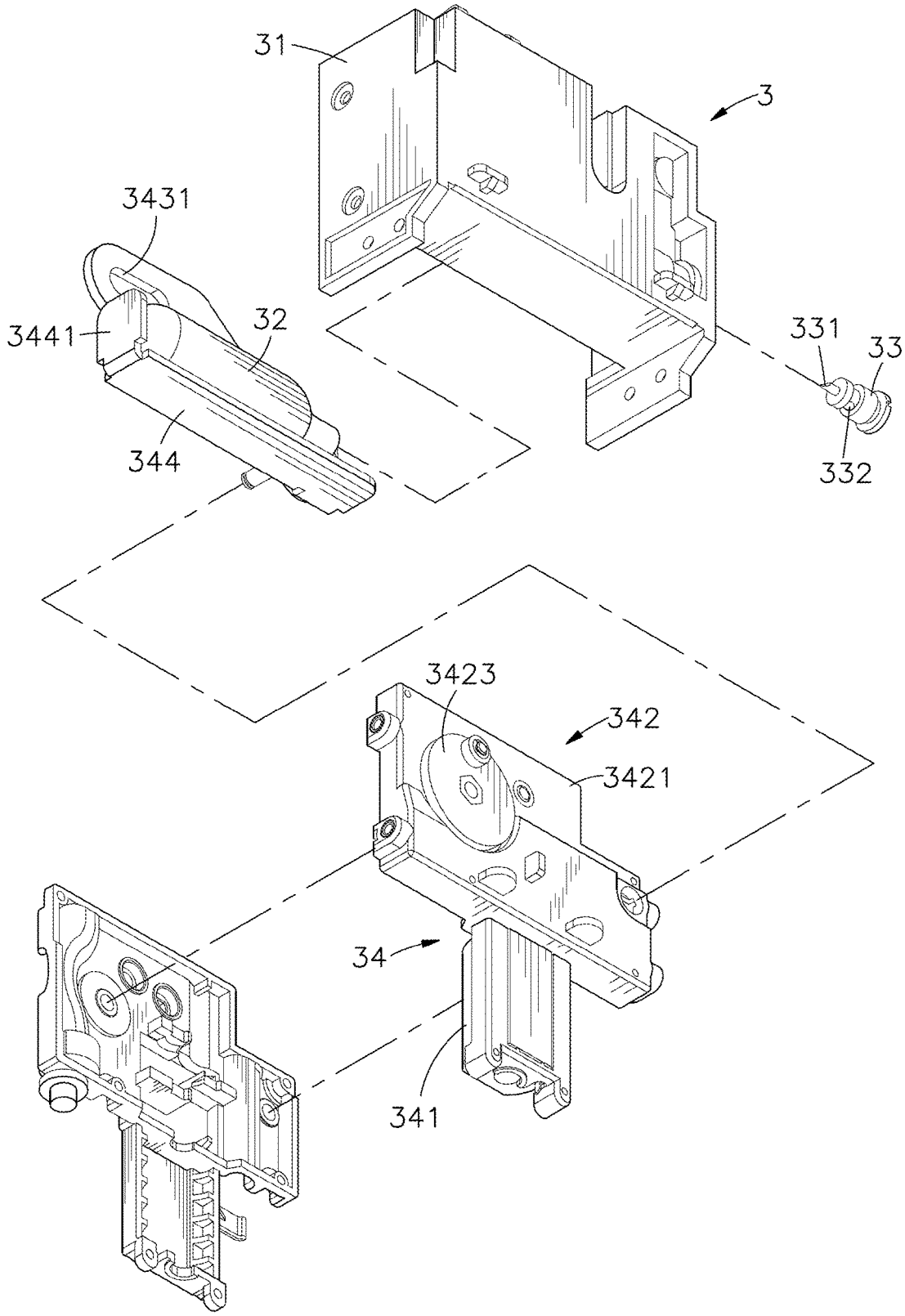
FIG. 7 corresponds to FIG. 6 when viewed from another angle.
Figure 8:
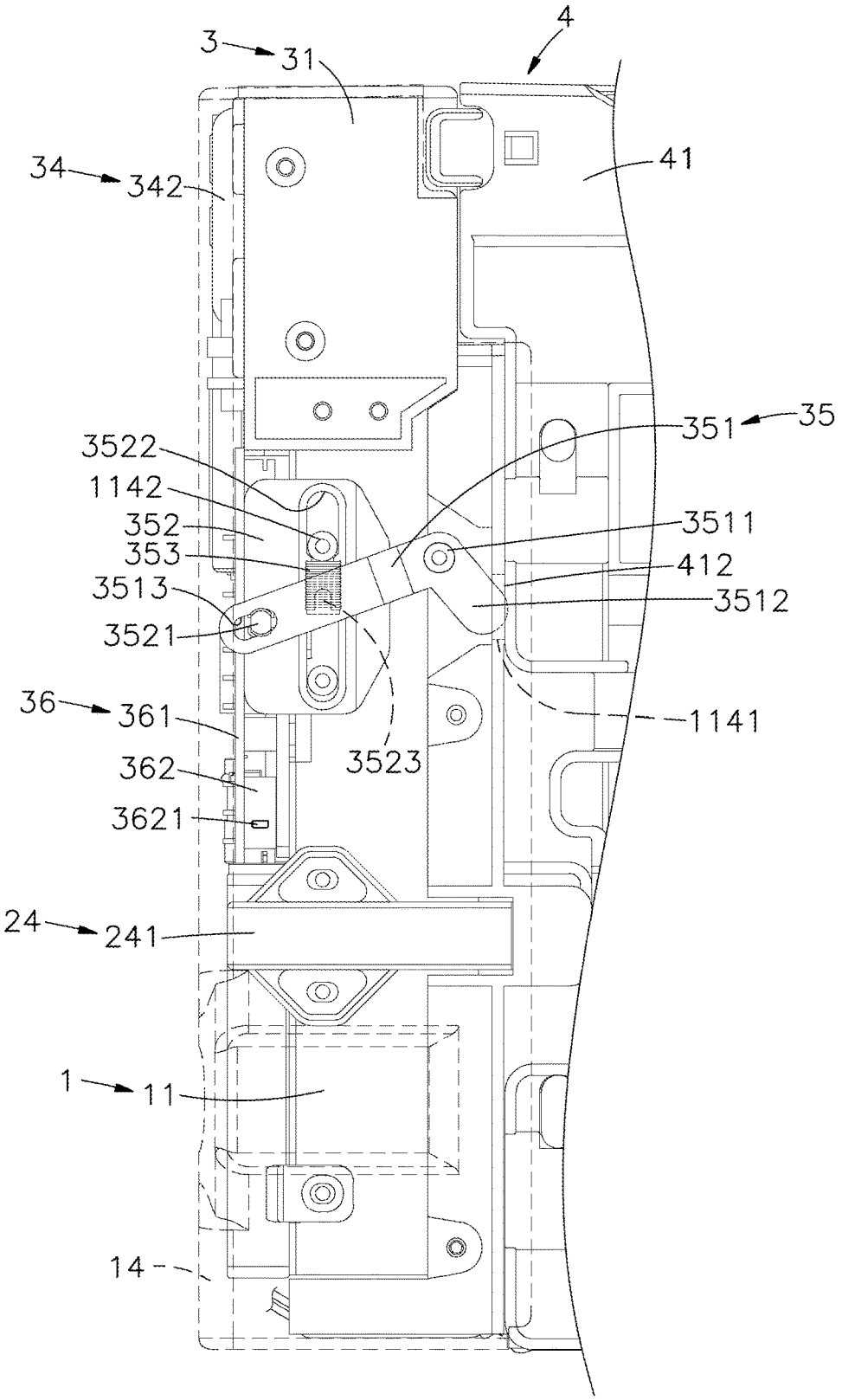
FIG. 8 is a schematic side view illustrating the cash box jointed to the host machine.
Figure 9:
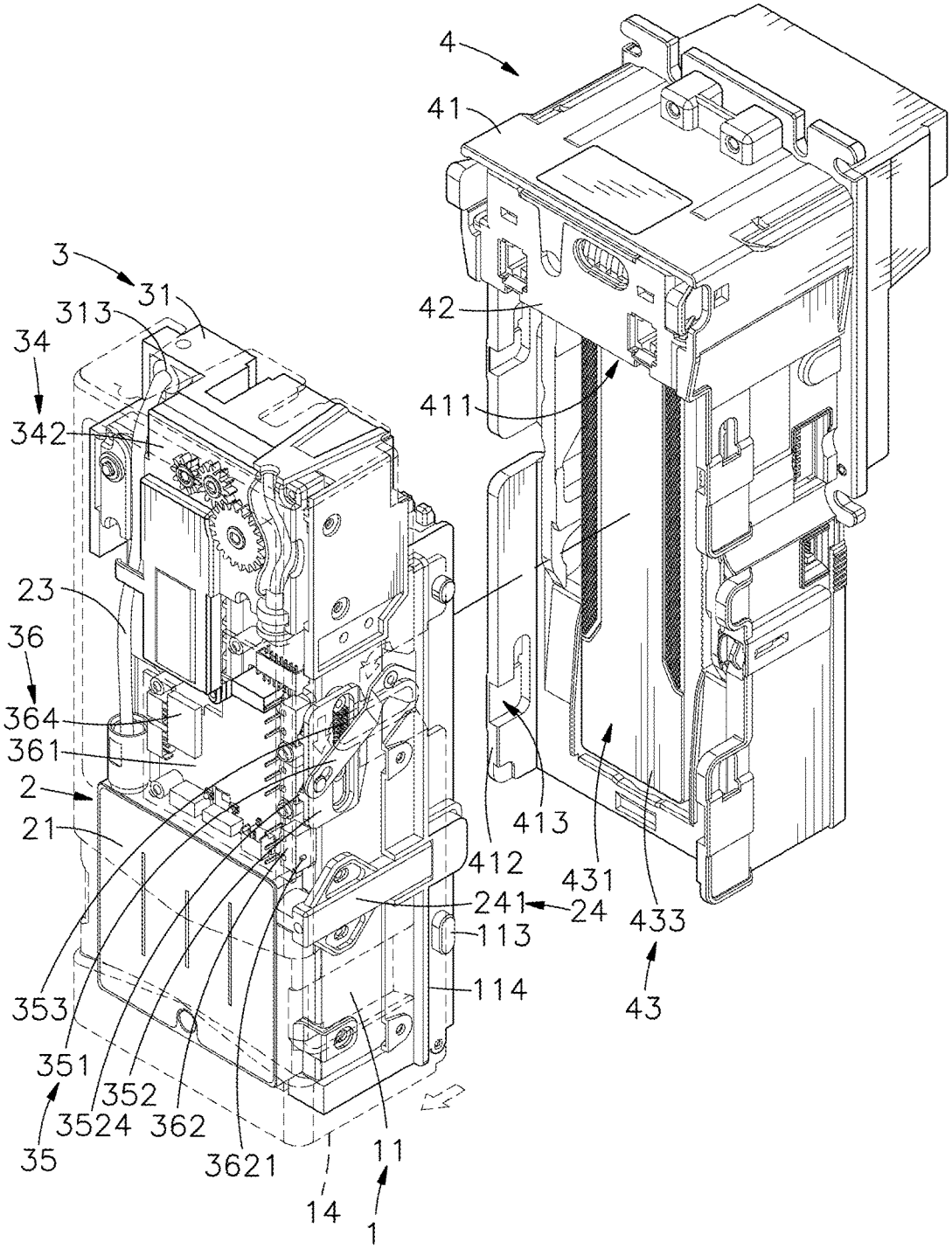
FIG. 9 is a schematic drawing illustrating the cash box separated from the host machine, the trigger unit of the anti-theft security device triggered.
Figure 10:
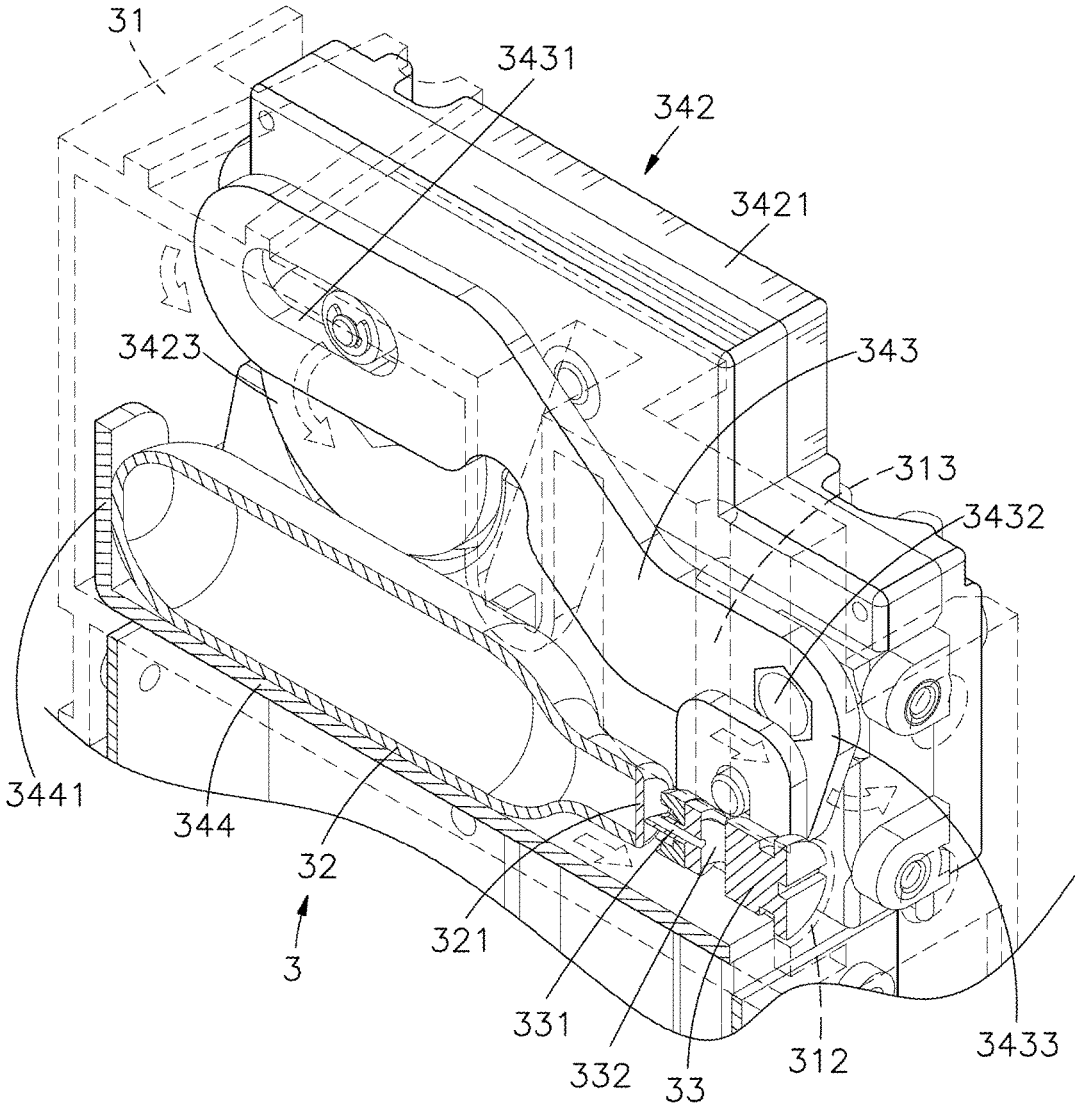
FIG. 10 is a schematic drawing illustrating the relatively positioning between the needle valve unit and gas cylinder of the anti-theft security device before actuation of the drive unit.
Figure 11:
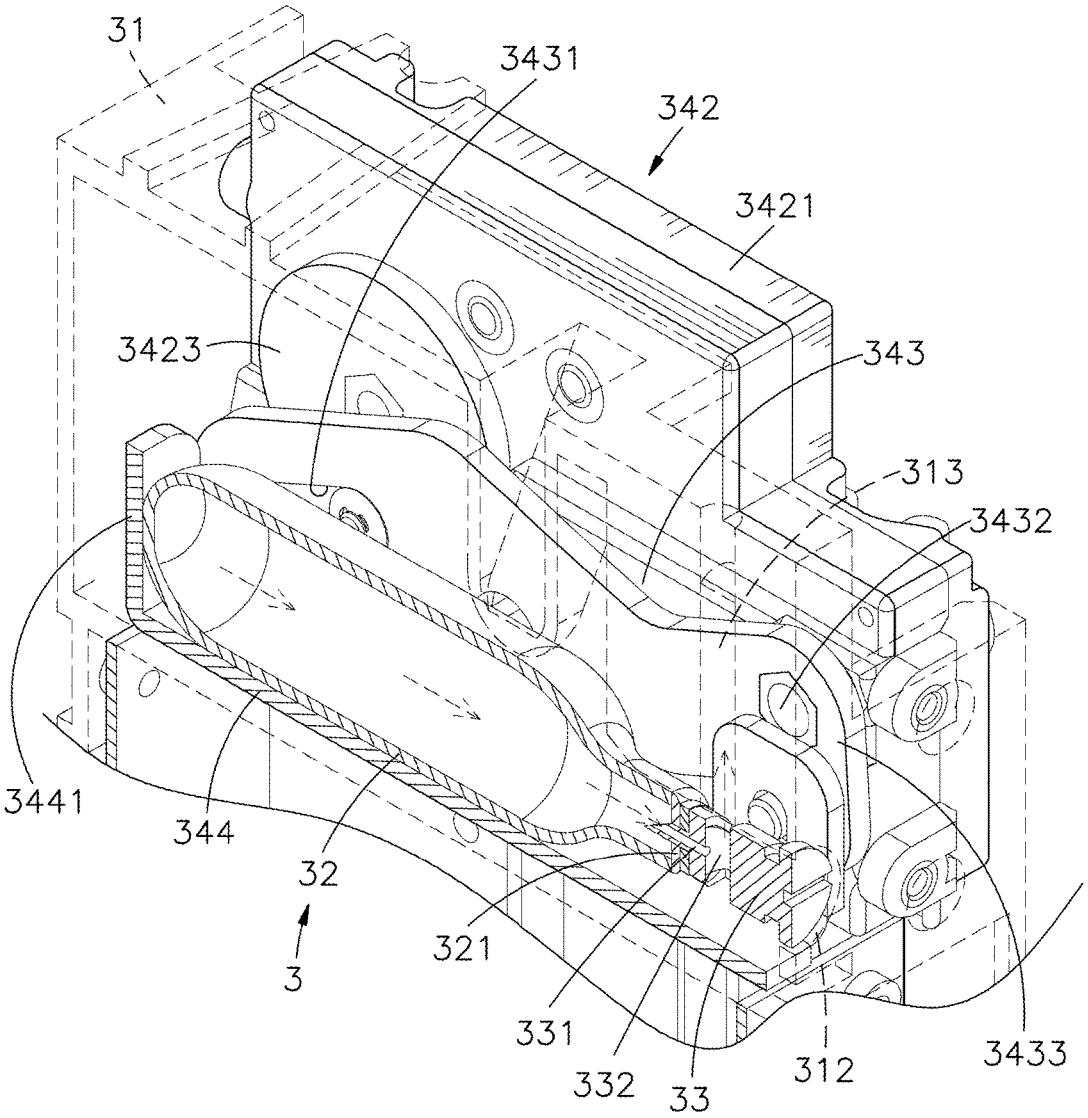
FIG. 11 corresponds to FIG. 10, illustrating the needle of the needle valve unit pierced the air seal diaphragm of the gas cylinder.

Referring to FIGS. 1-8, an ink-staining anti-theft cash box in accordance with the present invention is shown. The ink-staining anti-theft cash box comprises a cash box 1, an ink-jet module 2, and an anti-theft security device 3.

The cash box 1 comprises a box body 11 defining therein an accommodation chamber 10 with a front opening 101, a pivot axle 111 transversely mounted to the box body 11 at a bottom side of the front opening 101, a hollow frame type door panel 112 pivotally connected to the pivot axle 111 and adapted for closing the front opening 101, a plurality of retaining rods 113 symmetrically located on two opposite sidewalls of the box body 11 near the front opening 101, two mounting rails 114 respectively and longitudinally arranged on the two opposite sidewalls of the box body 11 at a rear side relative to the retaining rods 113, a through hole 1141 transversely cut through one mounting rail 114, two position-limiting rods 1142 located on one sidewall of the box body 11 at different elevations and disposed at a rear side relative to the through hole 1141, a passage hole 102 cut through one sidewall of the box body 11 in communication with the accommodation chamber 10 and spaced below the through hole 1141, a plurality of elastic members 13 mounted in the box body 11 inside the accommodation chamber 10, a pressure board 12 supported on the elastic members 13 and forced by the elastic members 13 to stop against an inner side of the hollow frame type door panel 112, and an outer shell 14 made of plastics, metal or other material and fastened to the mounting rails 114 to surround a back side of the box body 11 and defining with the box body 11 a mounting chamber 140.

Figure 12:
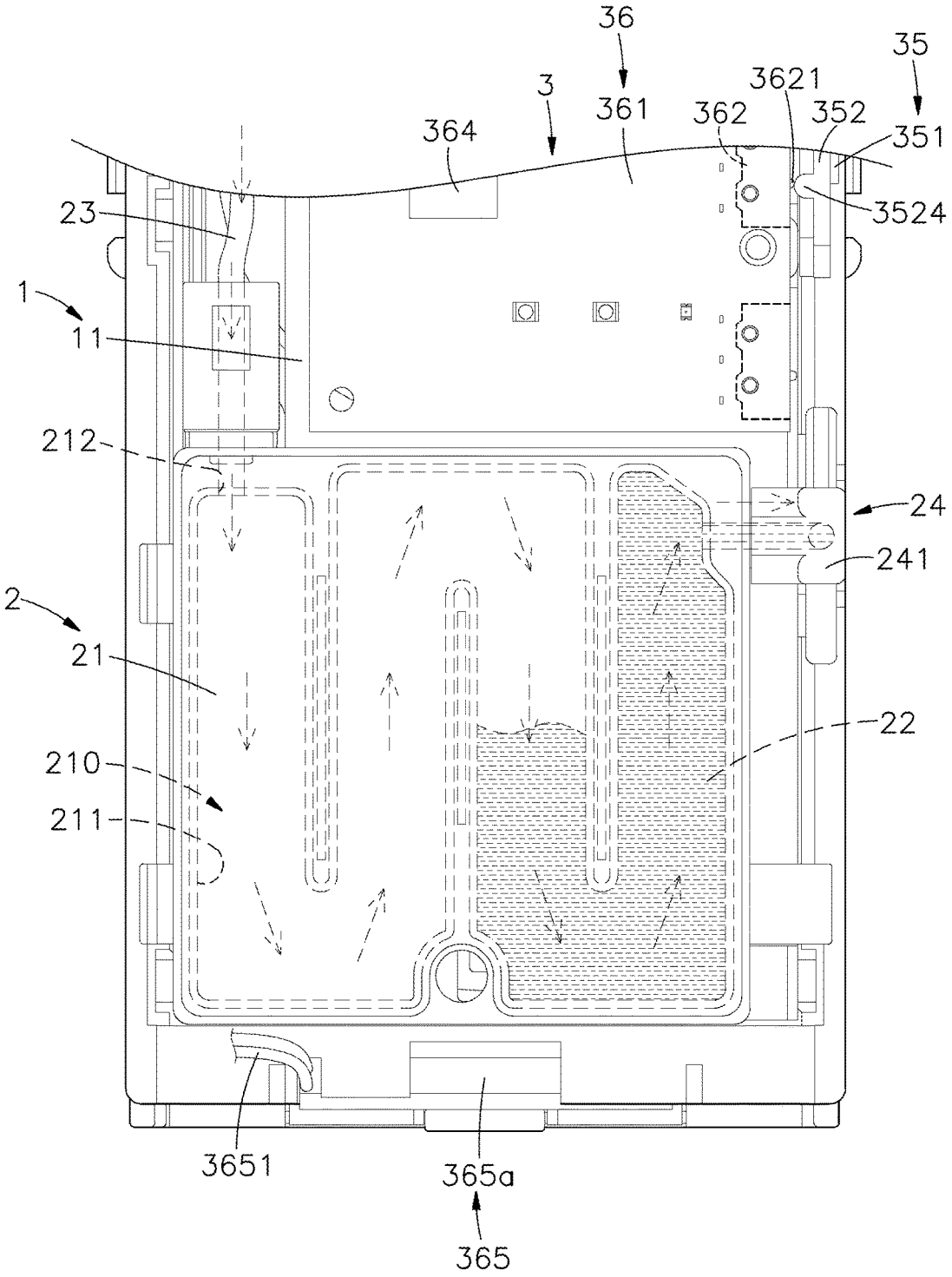
FIG. 12 is a schematic rear side view of the present invention, illustrating compressed gas released from the gas cylinder through the ink tube into the ink cartridge and ink ejected out of the ink cartridge.
Figure 13:
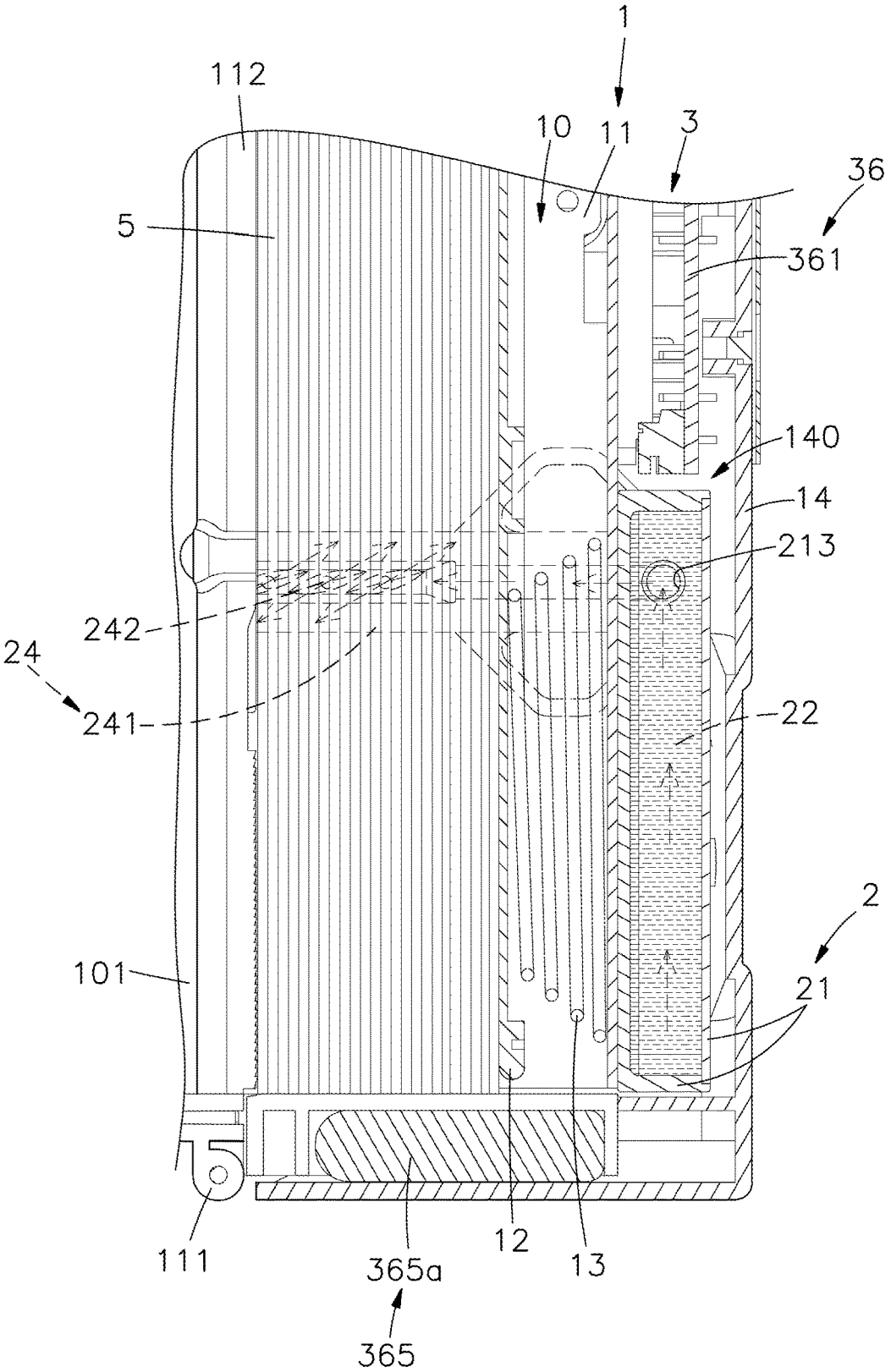
FIG. 13 is a schematic sectional side view of the present invention, illustrating ink ejected out of the ink cartridge through the nozzle assembly onto bills in the cash box.

The ink-jet module 2 comprises an ink cartridge 21 mounted to the box body 11 and disposed within the mounting chamber 140 of the outer shell 14. The ink cartridge 21 comprises an ink storage chamber 210, a continuously curved runner 211 defined in the ink storage chamber 210, an ink 22 filled in the continuously curved runner 211 (see FIG. 12 and FIG. 13), an ink inlet 212 and an ink outlet 213 respectively located on two opposite ends of the continuously curved runner 211, an ink tube 23 connected to the ink inlet 212 and extended to the outside of the ink cartridge 21, and a nozzle assembly 24 installed in the ink outlet 213. The nozzle assembly 24 comprises a nozzle holder 241 inserted through the passage hole 102 of the box body 11 into the accommodation chamber 10, and a plurality of jet nozzles 242 located on the nozzle holder 241 to face toward the inside of the accommodation chamber 10.

The anti-theft security device 3 is mounted to the box body 11 and disposed in the mounting chamber 140 within the outer shell 14. The anti-theft security device 3 comprises a holder base 31, a gas cylinder 32, a needle valve unit 33, a drive unit 34, a trigger unit 35 and a control module 36. The holder base 31 comprises an accommodation groove 311, a mounting through hole 312 aimed at one end of the accommodation groove 311, and a gas channel 313 disposed in communication with the mounting through hole 312 and connected to the ink tube 23. The gas cylinder 32 is mounted in the accommodation groove 311, having stored therein high-pressure carbon dioxide, nitrogen or other compressible gas or mixed gas. Further, the gas outlet (not shown) of the gas cylinder 32 is sealed with an air seal diaphragm 321.

The needle valve unit 33 is mounted in the mounting through hole 312 and aimed at the air seal diaphragm 321 of the gas cylinder 32, comprising a needle 331 and a valve hole 332 in communication with the needle 331. The needle 331 is aimed at the air seal diaphragm 321 of the gas cylinder 32 and normally disposed in a first position away from the gas cylinder 32. The valve hole 332 is disposed in communication with the gas channel 313 so that the needle valve unit 33 and the ink tube 23 are connected to each other to form a gas passage.

The drive unit 34 is mounted at a back side of the holder base 31, comprising a motor 341, a transmission mechanism 342, a linkage lever 343 and a slider 344. The transmission mechanism 342 comprises a gearbox 3421, a gear set 3422 mounted in the gearbox 3421, a drive wheel 3423 disposed outside the gearbox 3421 and coupled to the gear set 3422. The linkage lever 343 comprises a guide groove 3431 located at one end thereof and coupled to the drive wheel 3423, a pivot axle 3432 pivotally located at an opposite end thereof, and a shifting portion 3433 extended from the opposite end of the linkage lever 343 for movement with the linkage lever 343 relative to the pivot axle 3432. The slider 344 is pivotally connected to the shifting portion 3433 and adapted to carry the gas cylinder 32 in the accommodation groove 311 in a transverse position, having a push plate 3441 perpendicularly upwardly extended from one end thereof and stopped at a rear end of the gas cylinder 32.

The trigger unit 35 of the anti-theft security device 3 is mounted at one sidewall of the box body 11, comprising a pressure bar 351, a sliding block 352 and a compression spring 353 stopped between the pressure bar 351 and the sliding block 352. The pressure bar 351 comprises an abutment portion 3512 located at one end thereof and pivotally connected to the box body 11 near the through hole 1141 of the mounting rail 114 by a pivot 3511, and a position-limiting hole 3513 located at an opposite end thereof and pivotally coupled to a guide rod 3521 at one side of the sliding block 352. The sliding block 352 further comprises a sliding slot 3522 longitudinally movably coupled to the position-limiting rods 1142, a locating rod 3523 disposed near the midpoint of the sliding slot 3522 for securing one end of the compression spring 353 (see FIG. 8) for enabling the other end of the compression spring 353 to be stopped against one position-limiting rod 1142, and an abutment block 3524 located at an opposite side.

The control module 36 of the anti-theft security device 3 is mounted on the back side of the box body 11 between the ink cartridge 21 and the drive unit 34, comprising a circuit board 361 carrying a control circuit, a micro switch 362 installed in an inner surface of the circuit board 361 near its one lateral side and having an operating button 3621 that forms a misalignment with the abutment block 3524 of the sliding block 352 before triggering, a processing unit 363 installed in the circuit board 361 and electrically coupled with the micro switch 362, a Bluetooth module 364 installed in the circuit board 361 and electrically coupled to the processing unit 363, and a power supply device 365 electrically coupled to the processing unit 363 for providing the control module 36 with the necessary working electricity. The power supply device 365 comprises a storage battery **365*a* and a gold capacitor (super capacitor) 365*b*. The storage battery 365*a* is electrically connected to the control circuit of the circuit board 361 by a power line 3651. The gold capacitor 365*b* is directly installed in the circuit board 361 to connect with the control circuit, having the characteristics of high power, high energy, wide operating temperature range (−40~70° C.) and mini size and other features. The gold capacitor 365*b* is mainly used for motor start-up or backup power supply. Further, the motor 341 of the drive unit 34 is electrically connected to the control circuit of the circuit board 361 by a lead wire or power line. Further, the processing unit 363 control the setting and operation of the motor 341**.

The ink-staining anti-theft cash box is mounted in a host machine 4 of a bill acceptor, automatic vending machine, ATM, game machine or other service kiosk that can provide goods purchase or consumer services. The host machine 4 comprises a housing 41, a receiving unit 42 and a bill presser unit 43. The housing 41 comprises a bill passage 411 backwardly extended from a front bill slot (not shown) thereof for delivering an inserted bill 5, two mounting walls 412 bilaterally disposed at a back side thereof, and a retaining portion 413 defined in each mounting wall 412. The receiving unit 42 is mounted in the housing 41 to face toward the bill passage 411. The bill presser unit 43 is mounted in the housing 41 below the receiving unit 42, comprising a bill-pressing path 431, a transmission roller set 432 drivable by a power drive (not shown) to deliver each inserted bill 5 to the bill-pressing path 431, and a bill pressing-down plate 433 drivable by the power drive through a linkage (not shown) to push the bill 5 from the bill-pressing path 431 toward the box body 11 of the cash box 1.

The aforesaid receiving unit 42 comprises an impression roller set (not shown), an identity recognition device (not shown), a motor (not shown) adapted for driving the impression roller set to deliver the inserted bill 5 along the bill passage 411 of the housing 41 to the identify recognition device for recognition. The identify recognition device comprises a sampling and identification module for verifying the authenticity and value of the bill 5, and a plurality of sensors adapted for detecting the inserted bill 5 and controlling the operation of the motor in driving the impression roller set.

The cash box 1 is mounted in a rear side inside the housing 41 of the host machine 4 with the retaining rods 113 of the box body 11 respectively forced into engagement with the retaining portions 413 and the mounting rails 114 respectively abutted against the mounting walls 412 to keep the bill presser unit 43 in the front side of the front opening 101 of the box body 11 in alignment with the pressure board 12. Since the opening direction of the hollow frame type door panel 112 of the box body 11 is the direction in which the cash box 1 is installed in the host machine 4, the bill presser unit 43 can be driven by the power drive to move the bill pressing-down plate 433 in pushing each received bill 5 through the hollow frame type door panel 112 onto the pressure board 12 toward the inside of the accommodation chamber 10 to compress the elastic members 13 so that received bills 5 can be accommodated in the accommodation chamber 10 of the box body 11.

As the cash box 1 is installed in the host machine 4, the mounting rails 114 of the box body 11 are abutted against the respective mounting walls 412 of the housing 41, and the abutment portion 3512 of the pressure bar 351 of the trigger unit 35 of the anti-theft security device 3 is stopped by one mounting wall 412 from upward rotation. At this time, the position-limiting hole 3513 of the pressure bar 351 is supported on the pivot 3511 to act upon the guide rod 3521 of the sliding block 352, prohibiting the compression spring 353 from moving the sliding block 352 downward. Thus, the abutment block 3524 of the sliding block 352 is prohibited from pushing the operating button 3621 of the micro switch 362 at this time, avoiding the processing unit 363 of the control module 36 to activate the motor 341 of the drive unit 34 in driving the ink-jet module 2 to eject ink. At the same time, the control module 36 activates the anti-theft security device 3 for anti-theft protection. Further, the outer shell 14 shields the box body 11, the ink-jet module 2 and the anti-theft security device 3 in the cash box 1. Thus, the external of the cash box 1 is less vulnerable to damage and more difficult to be destroyed, providing enhanced anti-theft function.

Referring to FIGS. 9-13, if a criminal destroys the cash box 1 or removes the cash box 1 from host machine 4 without a normal operating procedure or disarming the anti-theft security device 3, the pressure bar 351 of the trigger unit 35 of the anti-theft security device 3 will be released from the constraint of the mounting wall 412 after displacement of the mounting rails 114 of the box body 11 from the mounting walls 412 of the housing 41 of the host machine 4. At this time, the compression spring 353 is released to push the sliding block 352 downward in triggering the micro switch 362 of the control module 36, and the sliding block 352 biases the pressure bar 351 upwardly through the mounting rail 114 toward the outside.

During the procedure that the trigger unit 35 works with the control module 36 to detect separation of the cash box 1 from the host machine 4, the processing unit 363 drives the motor 341 of the drive unit 34 to move the transmission mechanism 342 in biasing the linkage lever 343 according to the trigger signal from the micro switch 362, causing the slider 344 to move the gas cylinder 32 transversely toward the needle valve unit 33. At this time, the needle 331 of the needle valve unit 33 is moved from the first position to a second position to gas cylinder 32 to pierce the air seal diaphragm 321, causing the gas cylinder 32 to release internal compressed gas through the ink tube 23 of the ink-jet module 2 into the ink cartridge 21 to force the storage ink 22 through the continuously curved runner 211 into the nozzle holder 241 of the nozzle assembly 24, enabling the ink 22 to be ejected out of the jet nozzles 242 to stain the bills 5 in the cash box 1. Thus, the bills 5 will be stained with red, blue or cyan ink 22 and will immediately lose their original market value or transaction function. Thus, the invention can help stop thieves from stealing the cash box 1, having anti-theft effects and reducing chance of cash box 1 being damaged or bills 5 being stolen.

In the present preferred embodiment, the motor 341 of the drive unit 34 drives the transmission mechanism 342 to move the linkage lever 343 for lever ratio torque conversion, forcing the slider 344 to move the gas cylinder 32 toward the needle valve unit 33 so that the needle 331 can accurately pierce the air seal diaphragm 321 of the gas cylinder 32 and the gas cylinder 32 can release internal compressed gas through the ink tube 23 of the ink-jet module 2 into the ink cartridge 21. The design of the single-trip continuously curved runner 211 ensures smooth flowing of the ink 22, so that the amount of residual ink 22 is minimized. In the present preferred embodiment, the drive unit 34 is designed to move the gas cylinder 32 toward the needle valve unit 33 for enabling the air seal diaphragm 321 of the gas cylinder 32 to be passively pierced by the needle 331 to release compressed gas. Other alternative designs can be selectively employed to achieve the same effect without departing from the spirit and scope of the present invention. For example, the drive unit 34 can be designed to move the needle valve unit 33 toward the gas cylinder 32, and the needle 331 can actively pierce the air seal diaphragm 321 of the gas cylinder 32 to release compressed gas.

In the present preferred embodiment, the trigger unit 35 detects separation of the cash box 1 from the host machine 4 by: when the pressure bar 351 is released from constraint to release the compression spring 353, the sliding block 352 is forced by the compression spring 353 to trigger the micro switch 362 of the control module 36, causing the drive unit 34 to move the needle valve unit 33 in piercing the gas cylinder 32 for allowing compressed gas to go into the ink tube 23 so that the ink 22 in the ink cartridge 21 can be ejected out of the nozzle assembly 24 to stain the bills 5 in the cash box 1. In actual application, the trigger unit 35 can work with the control module 36 to detect separation of the cash box 1 from host machine 4 using mechanical detection means (linking means), optical detection means (photo sensor), magnetic detection means (Hall effect sensor, magnetoresistive sensor) or other non-mechanical sensor (such as displacement sensor, pressure sensor, etc.). Further, upon separation of the cash box 1 from the host machine 4, the trigger unit 35 can directly trigger the drive unit 34 to move the gas cylinder 32 toward the needle valve unit 33 for causing the gas cylinder 32 to release compressed gas into the ink tube 23 so that released compressed gas can force the ink 22 out of the ink cartridge 21 through the nozzle assembly 24.

In addition, when the host machine 4 is used in a low temperature or cold environment, in order to ensure normal functioning of the anti-theft operation of the that anti-theft security device 3, the storage battery 365*a* of the power supply device 365 of the control module 36 provides the system with the necessary working electricity. If the battery 365*a* cannot normally provide power supply due to lack of activity or reduced endurance at low temperature, the gold capacitor 365*b* can be triggered to release its storage energy to the control circuit of the circuit board 361, ensuring normal operation of the anti-theft security device 3. If the power line 3651 of the power supply device 365 is cut off by a thief with a cutting tool, the gold capacitor 365*b* can be triggered to provide storage energy, enabling the control module 36 to activate the anti-theft function of the anti-theft security device 3.

When the site manager wants to unlock cash box 1 or to remove it from host machine 4, the site manager can operate a built-in program of a mobile electronic device (remote controller or smart phone) to transmit an unlock (disarm) instruction through a Bluetooth module wirelessly to the Bluetooth module 364 of the control module 36, enabling the processing unit 363 to disable the motor 341 of the drive unit 34 according to the received unlock (disarm) instruction, and thus, the anti-theft security device 3 is disarmed. Thus, the site manager can remove the cash box 1 from the host machine 4 without triggering the anti-theft security device 3, preventing the ink-jet module 2 from ejecting the ink 22 to stain the storage bills 5 in the cash box 1. After the site manager disengages the retaining rods 113 of the box body 11 from the respective retaining portions 413 of the housing 41, the site manager can remove the cash box 1 from the host machine 4 and open the hollow frame type door panel 112 of the box body 11 to take storage bills 5 out of the box body 11, and then to install the empty cash box 1 in the host machine 4 again. The site manager can also install another empty cash box 1 in the host machine 4 after removable of the original cash box 1 with the storage bills 5 from the host machine 4, eliminating the troubles and inconvenience of the cash withdrawal operation on the spot.

After mounting the empty original cash box 1 back to the host machine 4, the pressure bar 351 of the trigger unit 35 is stopped against the mounting wall 412 of the housing 41 and biased downward to its previous position where the abutment block 3524 of the sliding block 352 is in misalignment with the operating button 3621 of the micro switch 362, then the site manager can operate the mobile electronic device to transmit a locking instruction through the Bluetooth module of the mobile electronic device to the Bluetooth module 364 of the control module 36 to activate and arm up the anti-theft security device 3.

In conclusion, the box body 11 of the cash box 1 is to be installed in a host machine 4 for receiving and storing bills 5; the box body 11 has mounted therein the ink-jet module 2 and the anti-theft security device 3; the anti-theft security device 3 consists of the gas cylinder 32, the needle valve unit 33, the drive unit 34 and the trigger unit 35; the needle valve unit 33 is connected with the ink tube 23 of the ink-jet module 2 to create a gas passage; when the trigger unit 35 of the anti-theft security device 3 detects abnormal separation of the cash box 1 from the host machine 4, the trigger unit 35 is triggered, and the drive unit 34 is activated to move the gas cylinder 32 toward the needle valve unit 33 from the first position to the second position where the air seal diaphragm 321 of the gas cylinder 32 is pierced by the needle valve unit 33, and the compressed gas of the gas cylinder 32 is released through the ink tube 23 into the ink cartridge 21 to force the ink 22 out of the nozzle assembly 24 for staining storage bills 5 in the box body 11, enhancing the security level of the cash box 1.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An ink-staining anti-theft cash box mounted in a housing of a host machine for receiving each bill being delivered from a bill passage in said housing and pressed by a bill presser unit of said host machine, said ink-staining anti-theft cash box comprising a cash box, an ink-jet module and an anti-theft security device, wherein:

said cash box comprises a box body detachably mounted to mounting walls of said host machine, said box body comprising an accommodation chamber, a front opening disposed in communication with said accommodation chamber and facing toward said bill presser unit and a pressure board movably mounted in said accommodation chamber for receiving each bill being pressed by said bill presser unit;

said ink-jet module comprises an ink cartridge mounted in said box body, a continuously curved runner defined in said ink cartridge, an ink stored in said continuously curved runner, an ink inlet and an ink outlet respectively located on two opposite ends of said continuously curved runner, an ink tube connected to said ink inlet and a nozzle assembly connected to said ink outlet and disposed in communication with said accommodation chamber;

said anti-theft security device comprises a gas cylinder sealed with an air seal diaphragm and mounted in said box body, a needle valve unit, a drive unit and a trigger unit adapted for triggering said drive unit upon detection of separation of said cash box from said host machine, said needle valve unit being connected to said ink tube to create a gas passage and movable between a first position where said drive unit is inactivated and said needle valve unit is aimed at and kept apart from said air seal diaphragm of said gas cylinder and a second position where said drive unit is activated to move said gas cylinder toward said needle valve unit and said needle valve unit pierces said air seal diaphragm of said gas cylinder for releasing a compressed gas from said gas cylinder through said ink tube into said ink cartridge to force said ink out of said nozzle assembly for staining storage bills in said box body.

2. The ink-staining anti-theft cash box as claimed in claim 1, wherein said box body of said cash box further comprises a pivot axle disposed at a bottom side of said front opening, and a hollow frame type door panel pivotally connected to said pivot axle for stopping said pressure board in said cash box, the biasing direction of said hollow frame type door panel being the mounting direction of said cash box in said host machine for allowing said bill presser unit to push each received bill through said hollow frame type door panel toward the inside of said box body.

3. The ink-staining anti-theft cash box as claimed in claim 1, wherein said cash box further comprises a plurality of retaining rods symmetrically located on two opposite sidewalls of said box body near said front opening, and two mounting rails respectively and longitudinally arranged on the two opposite sidewalls of said box body at a rear side relative to said retaining rods; said housing of said host machine comprises two mounting walls bilaterally disposed at a back side thereof, and a retaining portion defined in each of said two mounting walls for receiving one respective retaining rod of said cash box.

4. The ink-staining anti-theft cash box as claimed in claim 3, wherein said cash box further comprises an outer shell fastened to said two mounting rails to surround a back side of said box body and defining with said box body a mounting chamber for accommodating said ink-jet module and said anti-theft security device.

5. The ink-staining anti-theft cash box as claimed in claim 1, wherein said cash box further comprises a plurality of elastic members mounted in said box body to support said pressure board; said host machine further comprises a receiving unit mounted in said housing to face toward a bill passage in said housing; said bill presser unit is mounted in said housing below said receiving unit, a transmission roller set drivable by a power drive to deliver each inserted bill to a bill-pressing path and a bill pressing-down plate drivable to push each bill from said bill-pressing path toward the inside of said box body of said cash box.

6. The ink-staining anti-theft cash box as claimed in claim 1, wherein said ink cartridge of said ink-jet module comprises an ink storage chamber with said continuously curved runner defined therein; said ink tube connected to said ink inlet of said continuously curved runner is a soft tube or hard tube; said nozzle assembly comprises a nozzle holder connected to said ink outlet and extended through said box body into said accommodation chamber, and a plurality of jet nozzles mounted in said nozzle holder and disposed in communication with said accommodation chamber.

7. The ink-staining anti-theft cash box as claimed in claim 1, wherein said anti-theft security device further comprises a holder base mounted in said box body and defining therein an accommodation groove, a mounting through hole aimed at one end of said accommodation groove and a gas channel disposed in communication with said mounting through hole and connected to said ink tube; said gas cylinder is mounted in said accommodation groove of said holder base with said air seal diaphragm aimed at said mounting through hole; said needle valve unit is mounted in said mounting through hole, comprising a needle for piercing said air seal diaphragm of said gas cylinder and a valve hole in communication with said needle, said valve hole being disposed in communication with said gas channel and said ink tube to create said gas passage.

8. The ink-staining anti-theft cash box as claimed in claim 1, wherein said drive unit of said anti-theft security device comprises a motor, a transmission mechanism drivable by said motor, a linkage lever pivotally coupled to said transmission mechanism and a slider pivotally connected to said linkage lever opposite to said transmission mechanism for carrying said gas cylinder.

9. The ink-staining anti-theft cash box as claimed in claim 8, wherein said transmission mechanism of said drive unit comprises a gearbox, a gear set mounted in said gearbox, a drive wheel disposed outside said gearbox and coupled to said gear set; said linkage lever comprises a guide groove located at one end thereof and coupled to said drive wheel, a pivot axle pivotally located at an opposite end thereof and fastened to a holder base and a shifting portion extended from said linkage lever for movement with said linkage lever relative to said pivot axle; said slider is pivotally connected to said shifting portion and adapted to carry said gas cylinder in an accommodation groove in a transverse position toward said valve unit.

10. The ink-staining anti-theft cash box as claimed in claim 8, wherein said trigger unit of said anti-theft security device comprises a pressure bar stopped by each of said two mounting walls of said housing, a sliding block pivotally connected to said pressure bar and a compression spring stopped between said pressure bar and said sliding block, said compression spring avoids the movement of said sliding block, when said pressure bar is stopped by each of said two mounting walls; said anti-theft security device further comprises a control module, said control module comprising a circuit board carrying a control circuit, a micro switch installed in an inner surface of said circuit board and triggerable by said sliding block and a processing unit installed in said circuit board and electrically coupled with said micro switch for controlling the operation of said motor of said drive unit.

11. The ink-staining anti-theft cash box as claimed in claim 10, wherein said pressure bar comprises an abutment portion located at one end thereof and pivotally connected to said box body by a pivot, and a position-limiting hole located at an opposite end of said pressure bar and pivotally coupled to a guide rod at one side of said sliding block; an abutment block located at an opposite side of said sliding block.

12. The ink-staining anti-theft cash box as claimed in claim 11, wherein said cash box further comprises a plurality of retaining rods symmetrically located on two opposite sidewalls of said box body near said front opening, and two mounting rails respectively and longitudinally arranged on the two opposite sidewalls of said box body at a rear side relative to said retaining rods, a through hole transversely cut through one said mounting rail and two position-limiting rods located on one sidewall of said box body at different elevations and disposed at a rear side relative to said through hole; and said sliding block of said trigger unit further comprises a sliding slot longitudinally movably coupled to said position-limiting rods, a locating rod disposed near the midpoint of said sliding slot for securing one end of said compression spring for enabling an opposite end of said compression spring to be stopped against one said position-limiting rod.

13. The ink-staining anti-theft cash box as claimed in claim 10, wherein said control module further comprises a Bluetooth module electrically coupled to said processing unit.

14. The ink-staining anti-theft cash box as claimed in claim 10, wherein said control module further comprises a power supply device electrically coupled to said processing unit, said power supply device comprising a storage battery electrically connected to said circuit board by a power line.

15. The ink-staining anti-theft cash box as claimed in claim 10, wherein said control module further comprises a power supply device electrically coupled to said processing unit, said power supply device comprising a storage battery and a gold capacitor, said storage battery being electrically connected to said circuit board by a power line, said gold capacitor being directly installed in said circuit board.

* * * * *